US007597468B2

(12) United States Patent
Weng et al.

(10) Patent No.: US 7,597,468 B2
(45) Date of Patent: Oct. 6, 2009

(54) LIGHT SOURCE OF SIDE-EDGE TYPE LED BACKLIGHT UNIT

(75) Inventors: Derchin Weng, Taipei (TW); Jiun-Yi Yeh, Taipei (TW)

(73) Assignee: Promate Electronic Co., Ltd., Taipei (TW)

( * ) Notice: Subject to any disclaimer, the term of this patent is extended or adjusted under 35 U.S.C. 154(b) by 215 days.

(21) Appl. No.: 11/727,193

(22) Filed: Mar. 23, 2007

(65) Prior Publication Data

US 2008/0231196 A1 Sep. 25, 2008

(51) Int. Cl.
*F21V 5/00* (2006.01)

(52) U.S. Cl. ..... 362/612; 362/800; 362/608; 362/613; 349/61; 349/65

(58) Field of Classification Search ..... 362/600–634; 349/61, 65
See application file for complete search history.

(56) References Cited

U.S. PATENT DOCUMENTS

| | | | | |
|---|---|---|---|---|
| 7,286,193 | B2 * | 10/2007 | Yoo et al. | 349/62 |
| 2002/0043943 | A1 * | 4/2002 | Menzer et al. | 315/291 |
| 2002/0101362 | A1 * | 8/2002 | Nishimura | 340/907 |
| 2003/0053307 | A1 * | 3/2003 | Talamo et al. | 362/153.1 |
| 2006/0097978 | A1 * | 5/2006 | Ng et al. | 345/102 |
| 2006/0104090 | A1 * | 5/2006 | Lengyel et al. | 362/612 |

* cited by examiner

*Primary Examiner*—Sandra L O'Shea
*Assistant Examiner*—Danielle Allen
(74) *Attorney, Agent, or Firm*—Muncy, Geissler, Olds & Lowe, PLLC

(57) ABSTRACT

A light source of side-edge type light-emitting diode (LED) backlight unit for using in a liquid crystal display (LCD) comprises a substantial LED bar, at least one primary LED set preset as the light source of the LCD, and at least one backup LED set. The primary LED set(s) and backup LED set(s) are composed of a plurality of LED and disposed at the LED bar, and a backup LED set will be enlightened and substituted for one primary LED set as the light source when the primary LED set is broken-down so that the light source for the LCD is maintained at constant levels.

13 Claims, 3 Drawing Sheets

LIGHT SOURCE OF SIDE-EDGE TYPE LED BACKLIGHT UNIT

FIELD OF THE INVENTION

The present invention relates to a backlight unit having light emitting diodes (LEDs) as a light source, and more particularly, to a light source of a backlight unit in which the light source includes at least one primary LED set and at least one backup LED set affixed to a LED bar that permit to control the LED bar for enlightening the backup LED set when the primary LED set broke down so that the light source for liquid crystal display (LCD) is maintained at constant levels.

DESCRIPTION OF THE PRIOR ART

A backlight system is disposed at the backlight unit to be the main light source for the LCD panel. As is known an LCD panel does not emit light; rather, the displaying effect is produced by control light from a side or backside lighting system that provides illumination for the LCD panel. A common light source, such as fluorescent lamps or LEDs, is used at the backlight unit that provides light to the LCD panel via direct illumination or side-emitting illumination. As shown in FIG. 3A, light from a light source 32 in the side-edge type backlight unit is emitted in lateral direction and then redirected upward via a reflective plate 31 or via a scattering pattern to illuminate the LCD panel. Consequently, using the side-edge type backlight unit will reduce the thickness of LCD.

Because of the advanced development in the recent year, LED has already made its illumination efficiency as good as fluorescent lamps. Some advantages of LED have made it promising as the future of lighting in the LCD industry and is expected to replace fluorescent lamps, such as, the small size and lighted weight of LED cut down on equipment and accident, extremely long-life span of LED reduces the need of maintenance in hot environments. In addition, increased visibility and immediate illumination of LED-based backlight system enable LCD to respond faster and consume less energy. LED also provides much better color gamut for LCD panel that can exceed 100% NTSC (National Television Standards Committee). Moreover, LCD with LED Backlight can provide all the solutions including components, optics, driving circuit, thermal design, color sensing circuit and frame, offer displays which are thinner than current LCD, and become the mainstream of present backlight development.

With the development tends to provide a system brighter, lighter and thinner, a side-edge type LED backlight unit (as shown in FIG. 3B) uses a LED bar 32 with high density LEDs 321 arranged front to back. However, heat generation in LED display applications may be a disadvantage inherent when LEDs are disposed in tightly lineal configuration, and the equipment might be damaged by high operating temperature, with a resultant decreased life and output of LEDs. If heat accumulation is not handled properly, an even more serious consequence is that LED color might be changed by high temperature in terms of brightness level and/or wavelength, leading to display imaging inconsistency.

In view of this, there is a need for an improved side-edge type LED backlight unit, and the inventor had the motive to try and develop the present invention after hard study.

SUMMARY OF THE INVENTION

A first object of the present invention is to provide a light source of a side-edge type LED backlight unit assembly in combination with at least one backup LED set for every primary LED set at a LED bar, and enlighten one backup LED set when a primary LED set broke down so that the light source for LCD panel is maintained at constant levels for a long time.

It is a second object of the present invention to provide a light source of a side-edge type LED backlight unit to alternately enlighten a primary LED set and a backup LED set disposed at a LED bar for increasing life span of the backlight unit.

In order to achieve the aforementioned objects, a light source for use in a side-edge type LED backlight unit according to the present invention comprises a substantial LED bar, at least one primary LED set and at least one backup LED set. The primary LED set(s) and the backup LED set(s) are assembled at the same LED bar and arranged in lineal arrays, and one of the backup LED set(s) will enlighten and substitute for a primary LED set as the light source when any primary LED set broke down so that the light source for the LCD panel is maintained at constant levels.

Other objects, advantages and features of this invention will become apparent from the following detailed description when taken in conjunction with the accompanying drawings.

DETAILED DESCRIPTION OF THE PREFERRED EMBODIMENT

Figure 1A:
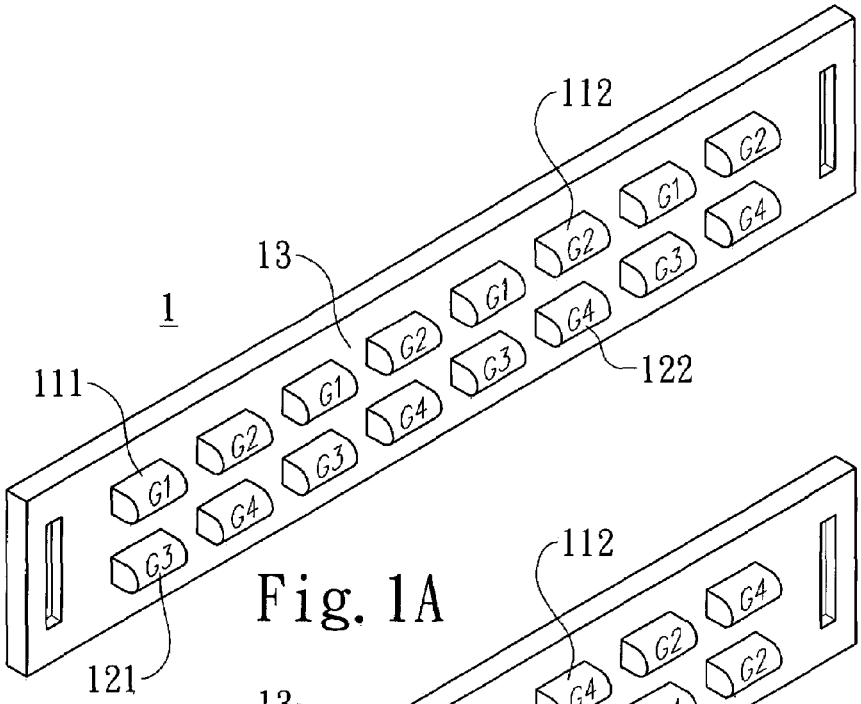
FIG. 1A is a perspective view showing a embodiment of the present invention.

Referring to FIG. 1A, there is illustrated a first embodiment of a light source 1 constructed in accordance with the present invention for use in a side-edge type LED backlight unit.

The light source 1 includes a substantial LED bar 13, two primary LED sets G1 (111) and G2 (112), and two backup LED sets G3 (121) and G4 (122) for the primary LED sets G1 (111) and G2 (112) respectively.

Figure 2:
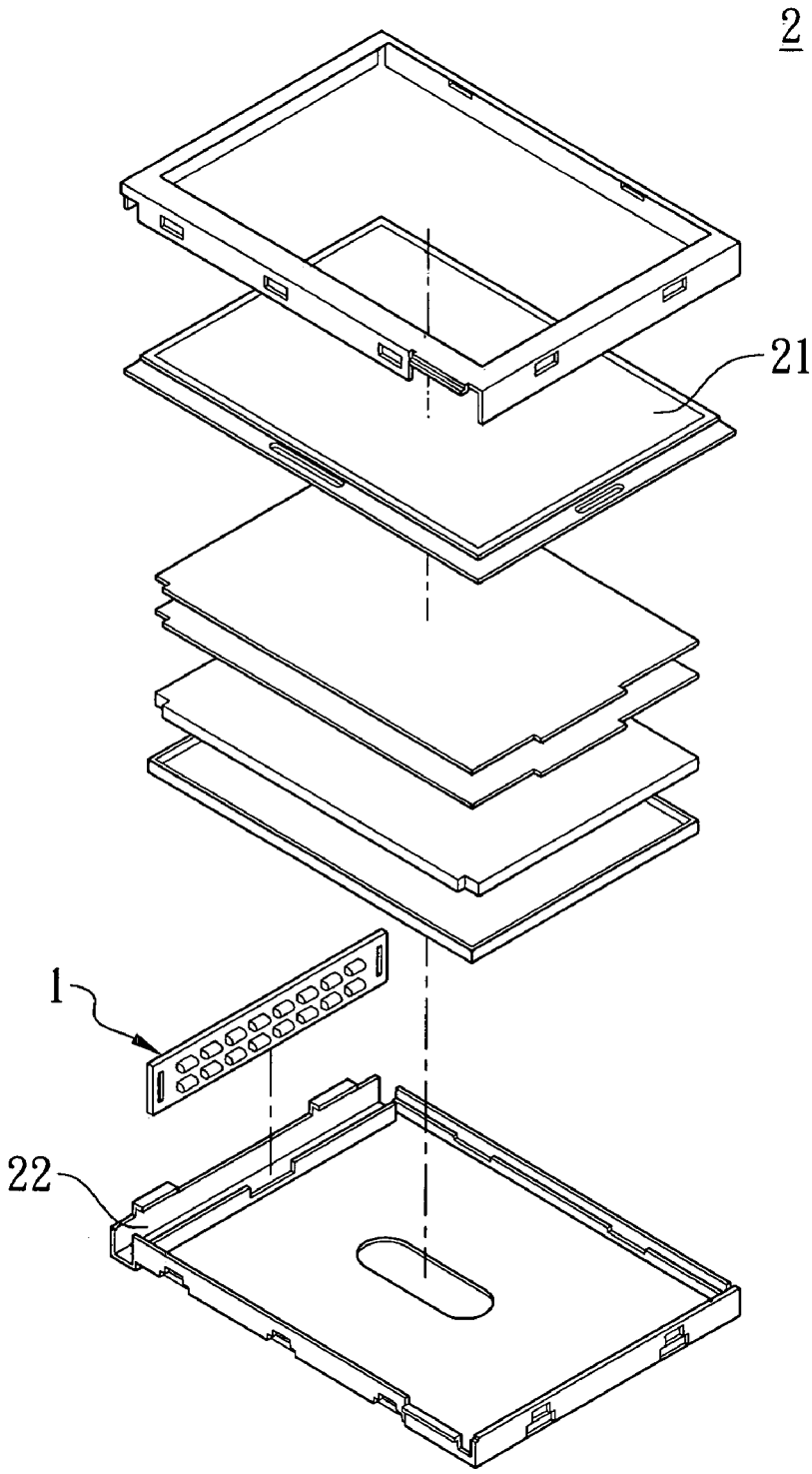
FIG. 2 is an exploded perspective view of a backlight unit applied with the embodiments of the present invention.
Figure 3A:
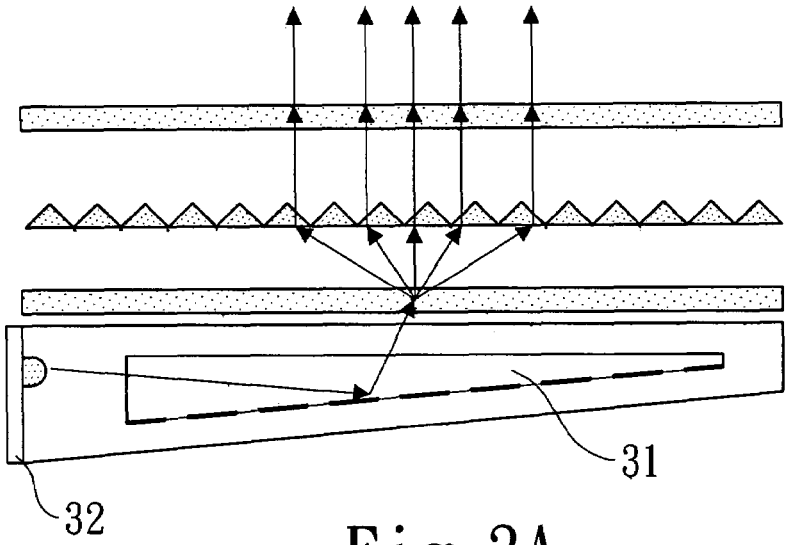
Fig. 3A (Prior Art)
FIG. 3A illustrates a side view of a prior art backlight unit using LEDs as the light source.
Figure 3B:
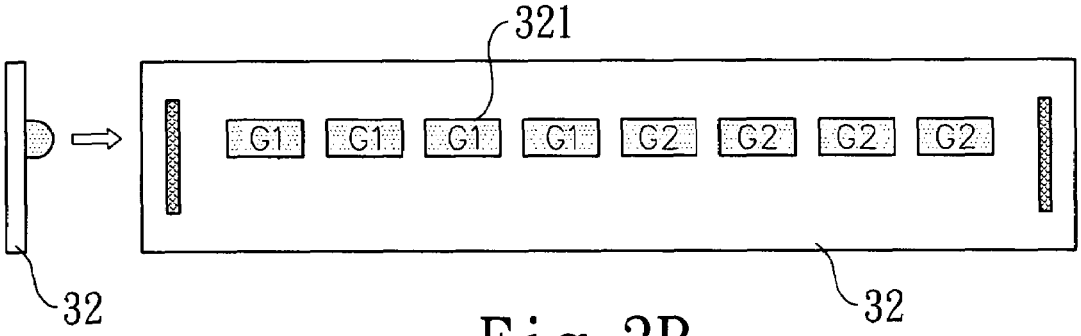
Fig. 3B (Prior Art)
FIG. 3B is a perspective view showing a prior art LED bar using LEDs arranged in a single line.

The four LED sets (G1, G2, G3, G4) are constituted by white light LEDs, and assembled at the LED bar 13 in lineal arrays, where every LED set (111, 112, 121, 122) can be driven independently. Besides, the LEDs of primary LED sets (111, 112) are positioned in one row, and the LEDs of backup LED sets (121, 122) are positioned in an adjacent row thereto. Furthermore, the LEDs of every LED set (111, 112, 121, 122) are alternately arranged thereat. Referring to FIG. 2, the light source 1 is located on the lateral side of the supporting rack 22 of LED backlight unit 2, and provides light for the LCD panel 21. The LED bar 13 could be a PCB (printed circuit board), a flexible board or a metal board for LEDs electronically interconnect thereon.

In practice, when any LED of the primary LED set G1 (111) breaks down or fails to illuminate consistently, the LED bar 13 can be controlled by adjusting the software automatically or manually to turn off the primary LED set G1(111) and enlighten the backup LED set G3 (121) so that the light source 1 for the LCD panel 21 is maintained at constant levels.

Corresponsively, when any LED of the primary LED set G2 (112) breaks down or fails to illuminate a consistent light, the LED bar 13 can be controlled by adjusting the software automatically or manually to turn off the primary LED set G2 (112) to enlighten the backup LED set G4 (122) so that the light source 1 for the LCD panel 21 is maintained at constant levels.

Figure 1B:
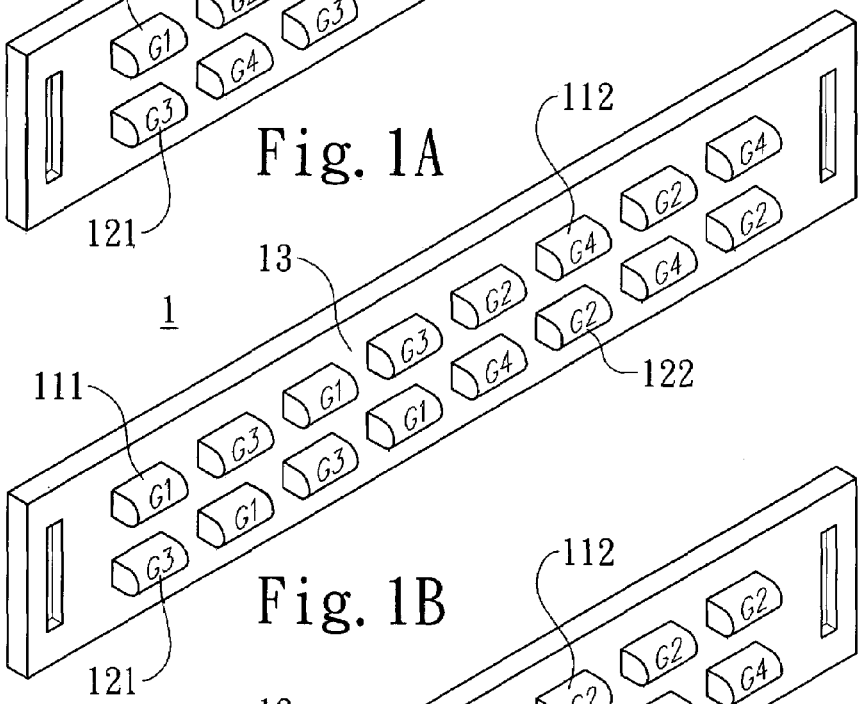
FIG. 1B is a perspective view showing another embodiment of the present invention.

FIG. 1B shows another embodiment where the primary LED set G1 (111) and G2 (112) and the backup LED sets G3 (121) and G4 (122) are alternately arranged in zigzag of two rows. In this configuration, the LED sets G1 (111), G2 (112), G3 (121) and G4 (122) can generate a two lines array to provide better brightness and life span when applied in a side-edge type LED backlight unit.

Figure 1C:
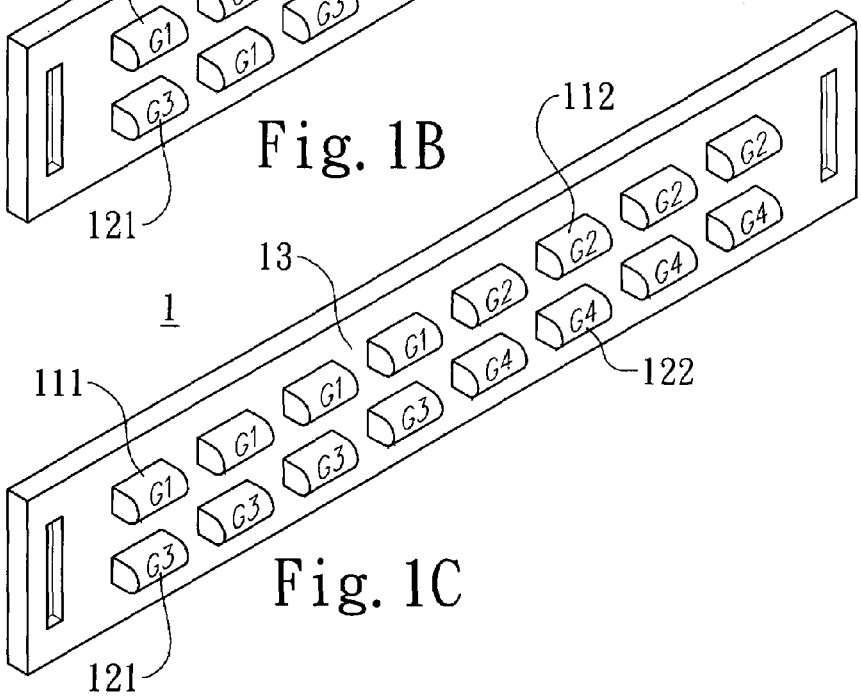
FIG. 1C is a perspective view showing another embodiment of the present invention.

FIG. 1C shows another configuration where the primary LED sets G1 (111) and G2 (112) are arranged one after another in the same row of the LED bar 13, and the backup LED bar G3 (121) and G4 (122) are arranged one after another in the other row.

Having described the invention in detail, every primary LED set is correspondent to one backup LED set at the LED bar. Consequently, as illustrated in the FIGS. 1A-1C, the coupled LED sets can maintain the light emitted from the backlight unit at constant levels by enlightening the backup LED set when one primary LED set broke down. In this approach, this invention is applicable over a wide range of LCD sizes.

From the foregoing, it is apparent that the present invention is advantageous in that:

1. the present invention provides a backup LED set for every primary LED set at the LED bar, which can replace the working of a primary LED set when any primary LED set broke down, thereby reducing the maintenance fee of a LCD;
2. When applied to a LCD, the present invention can automatically or manually control enlightening of the primary LED set or the backup LED set to maintain the light source of a backlight unit at constant levels without reassembling.

As stated in the above disclosed, the present invention can surely achieve its expected objects to provide a light source for side-edge type LED backlight unit used in a LCD to provide uniform light in the panel and improve the displaying performance of the LCD.

Although embodiments of structures and functions of the present invention have been described in detail, many modifications and variations may be made from the teachings disclosed hereinabove. It should be understood by those skilled in the art that any modification and variation equivalent to the spirit of the present invention shall be regarded to fall into the scope coved by the appended claims.

What is claimed is:

1. A light source of side-edge type light-emitting diode (LED) backlight unit, for using in a liquid crystal display (LCD), comprising:

a substantial LED bar;

at least one primary LED set disposed at the LED bar, the at least one primary LED set being composed of a plurality of LEDs and preset as the light source of the LCD; and at least one backup LED set composed of a plurality of LEDs and disposed also at the LED bar;

wherein the at least one primary LED set and the at least one backup LED set are arranged in lineal arrays, each primary LED set is correspondent to one backup LED set at the LED bar, and the LEDs of the primary and backup LED sets are arranged in two rows and alternate rows in adjacent columns; consequently, one set of the at least one backup LED set will be enlightened and substituted for one primary LED set as the light source when the primary LED set is broken-down so that the light source for the LCD is maintained at constant levels.

2. A light source of side-edge type light-emitting diode (LED) backlight unit, for using in a liquid crystal display (LCD), comprising:

a substantial LED bar;

at least one primary LED set disposed at the LED bar, the at least one primary LED set being composed of a plurality of LEDs and preset as the light source of the LCD; and at least one backup LED set composed of a plurality of LEDs and disposed also at the LED bar;

wherein the at least one primary LED set and the at least one backup LED set are arranged in lineal arrays, and the LEDs of the at least one primary LED set are positioned in one row, and the LEDs of the at least one backup LED set are positioned in an adjacent row; consequently, one set of the at least one backup LED set will be enlightened and substituted for one primary LED set as the light source when the primary LED set is broken-down so that the light source for the LCD is maintained at constant levels.

3. The light source of side-edge type LED backlight unit according to claim 1, wherein at least two primary LED sets are provided on the substantial LED bar and the primary LED sets are arranged one after another in each row of the LED bar.

4. The light source of side-edge type LED backlight unit according to claim 1, wherein at least two primary LED sets are provided on the substantial LED bar and the LEDs of the primary LED sets are alternately arranged in each row.

5. The light source of side-edge type LED backlight unit according to claim 1, wherein at least two backup LED sets are provided on the substantial LED bar and the backup LED sets are arranged one after another on each row of the LED bar.

6. The light source of side-edge type LED backlight unit according to claim 1, wherein at least two backup LED sets are provided on the substantial LED bar and the LEDs of the backup LED sets are alternately arranged in each row.

7. A light source of side-edge type light-emitting diode (LED) backlight unit, for using in a liquid crystal display (LCD), comprising:

a substantial LED bar;

at least one primary LED set disposed at the LED bar, the at least one primary LED set being composed of a plurality of LEDs and preset as the light source of the LCD; and at least one backup LED set composed of a plurality of LEDs and disposed also at the LED bar;

wherein the at least one primary LED set and the at least one backup LED set are arranged in lineal arrays, and each primary LED set is arranged after one backup LED set on one row of the LED bar; consequently, one set of the at least one backup LED set will be enlightened and substituted for one primary LED set as the light source when the primary LED set is broken-down so that the light source for the LCD is maintained at constant levels.

8. The light source of side-edge type LED backlight unit according to claim 1, wherein the LEDs used in the at least one primary LED set and the at least one backup LED set are white light LEDs.

9. The light source of side-edge type LED backlight unit according to claim 1, wherein said LED bar is a printed circuit board.

10. The light source of side-edge type LED backlight unit according to claim 2, wherein the LEDs used in the at least one primary LED set and the at least one backup LED set are white light LEDs.

11. The light source of side-edge type LED backlight unit according to claim 2, wherein said LED bar is a printed circuit board.

12. The light source of side-edge type LED backlight unit according to claim 7, wherein the LEDs used in the at least one primary LED set and the at least one backup LED set are white light LEDs.

13. The light source of side-edge type LED backlight unit according to claim 7, wherein said LED bar is a printed circuit board.

* * * * *